US010907387B2

(12) United States Patent
Och et al.

(10) Patent No.: US 10,907,387 B2
(45) Date of Patent: Feb. 2, 2021

(54) PUSH BUTTON DEVICE WITH PUSH ACTUATION WITH IMPROVED KINEMATICS FOR APPLICATION IN A VEHICLE

(71) Applicant: ILLINOIS TOOL WORKS INC., Glenview, IL (US)

(72) Inventors: Roland Och, Rottendorf (DE); Zsolt Wilke, Bad Mergentheim (DE); Kai Hamacher, Marktheidenfeld (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 630 days.

(21) Appl. No.: 15/518,695

(22) PCT Filed: Oct. 27, 2015

(86) PCT No.: PCT/US2015/057537
§ 371 (c)(1),
(2) Date: Apr. 12, 2017

(87) PCT Pub. No.: WO2016/077068
PCT Pub. Date: May 19, 2016

(65) Prior Publication Data

US 2017/0306662 A1 Oct. 26, 2017

(30) Foreign Application Priority Data

Nov. 12, 2014 (EP) ..... 14192842

(51) Int. Cl.
*E05B 81/78* (2014.01)
*E05B 85/10* (2014.01)
(Continued)

(52) U.S. Cl.
CPC ..... *E05B 81/78* (2013.01); *E05B 1/0038* (2013.01); *E05B 17/0083* (2013.01);
(Continued)

(58) Field of Classification Search
CPC ..... E05B 1/007; E05B 81/76; E05B 81/78; E05B 1/0038; E05B 85/10; G05G 1/023;
(Continued)

(56) References Cited

U.S. PATENT DOCUMENTS 1,556,864 A * 10/1925 Mendenhall ..... E05B 83/247 292/33
4,351,552 A 9/1982 VanDerLinden
(Continued)

FOREIGN PATENT DOCUMENTS

CN 101663449 3/2010
CN 102610405 7/2012
(Continued)

OTHER PUBLICATIONS

PCT, International Search Report and Written Opinion, International Application No. PCT/US2015/057537, dated Jan. 14, 2016, 14 pages.

*Primary Examiner* — Kristina R Fulton
*Assistant Examiner* — Faria F Ahmad
(74) *Attorney, Agent, or Firm* — Thompson Hine LLP

(57) ABSTRACT

Push button device for a motor vehicle, has: a mechanical and/or electric function controller with a first control state and a second control state; a push button element pressable from a disengaged state into a pressed state, wherein the function controller has the first control state when the push button element is in the disengaged state and the second control state when the push button element is in the pressed state, the push button element connected to the function controller by a first pivot arm mounted rotatably about a first axis of rotation and by a second pivot arm mounted rotatably about a different axis of rotation spaced apart from the first axis of rotation, wherein the first pivot arm and the second pivot arm are designed to be pivoted in an identical direction
(Continued)

Figure 1:
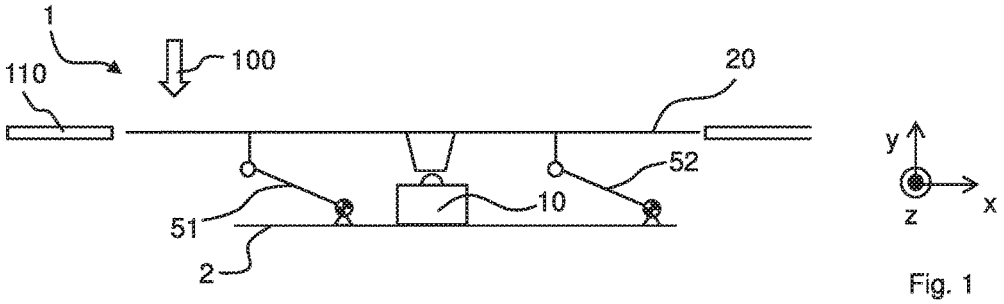

of rotation as a consequence of a movement of the push button element.

17 Claims, 5 Drawing Sheets

(51) Int. Cl.

| | |
|---|---|
| ***E05B 1/00*** | (2006.01) |
| ***G05G 1/02*** | (2006.01) |
| ***E05B 81/76*** | (2014.01) |
| ***E05B 17/00*** | (2006.01) |
| ***H01H 21/22*** | (2006.01) |
| ***H01H 3/12*** | (2006.01) |
| ***E05B 39/00*** | (2006.01) |
| ***E05B 15/04*** | (2006.01) |

(52) U.S. Cl.
CPC ..... *E05B 81/76* (2013.01); *E05B 85/10* (2013.01); *G05G 1/02* (2013.01); *H01H 21/22* (2013.01); *E05B 17/002* (2013.01); *E05B 39/007* (2013.01); *E05B 2015/0431* (2013.01); *H01H 3/122* (2013.01); *Y10S 292/37* (2013.01); *Y10T 292/57* (2015.04)

(58) Field of Classification Search
CPC ..... H01H 21/22; B60R 16/005; Y10S 292/37; Y10T 292/57
See application file for complete search history.

(56) References Cited

U.S. PATENT DOCUMENTS

| | | | | |
|---|---|---|---|---|
| 5,693,920 | A * | 12/1997 | Maeda | B60R 16/005 200/1 B |
| 8,469,412 | B2 | 6/2013 | Mizushima | |
| 8,916,788 | B2 | 12/2014 | Loitz | |
| 9,022,435 | B2 * | 5/2015 | Park | E05B 1/0007 292/217 |
| 2006/0279095 | A1 * | 12/2006 | Ishiguro | E05B 81/76 292/336.3 |
| 2010/0060019 | A1 | 3/2010 | Mizushima | |
| 2012/0193198 | A1 | 8/2012 | Loitz | |
| 2014/0034468 | A1 | 2/2014 | Krumpelman et al. | |
| 2014/0159390 | A1 | 6/2014 | Park | |
| 2015/0191944 | A1 * | 7/2015 | Kouzuma | E05B 81/34 292/336.3 |
| 2015/0197964 | A1 * | 7/2015 | Kouzuma | E05B 81/34 292/336.3 |
| 2016/0097225 | A1 * | 4/2016 | Tamaki | E05B 83/30 292/137 |
| 2016/0111231 | A1 * | 4/2016 | Choi | H01H 13/14 200/344 |
| 2016/0251880 | A1 * | 9/2016 | Bingle | E05B 81/76 701/49 |
| 2016/0339848 | A1 * | 11/2016 | Hodgson | E05B 65/0876 |

FOREIGN PATENT DOCUMENTS

| | | |
|---|---|---|
| DE | 10 2006 024292 | 11/2007 |
| DE | 202009009861 | 10/2009 |
| DE | 102013203846 | 4/2014 |
| DE | 102013203568 | 7/2014 |
| FR | 2254977 | 7/1975 |

* cited by examiner 26
2
20
33
52
34
10
61
23
70, 71
62.1
31
51
25
32
1
90
3
x
y
z 26
2
33
36
52
34
53
25
62.1
31
35
20
51
32
1
90
3
x
y
z

PUSH BUTTON DEVICE WITH PUSH ACTUATION WITH IMPROVED KINEMATICS FOR APPLICATION IN A VEHICLE

The invention relates to a push button device which is actuated by way of a pressing movement of a user. The invention also relates to the specific use of the device as a door actuator, for example as a door opener, of a vehicle side door.

DE 20 2009 009 861 U1 presents an already known door opener for attachment to the outer side of a vehicle door and having an actuation switch.

DE 10 2006 024 292 A1 presents an already known handle for the electric actuation of a closure on a flap or on a door in a vehicle by means of an electric switch.

The inventors have found the prior art to be disadvantageous insofar as, until now, no solution has been proposed for a push button device, in particular for a door opener for actuation by means of a pressing movement, which has the largest possible action surface and which permits a pleasant actuation feel with no or little jamming.

It is an object of the present invention to improve the disadvantages of the prior art. Said object is achieved by means of the independent claims. Advantageous refinements are defined in the subclaims.

The object is achieved in particular through the use of a push button device, described below, as a door actuator, preferably door opening control part and/or door locking control part, of a motor vehicle side door, in particular as a door exterior actuator, installed into the door exterior surface, or as a door interior actuator, installed into the door interior lining, of a motor vehicle side door. The invention is likewise realized by means of a motor vehicle side door having a push button device of said type as a door actuator, or a motor vehicle having a motor vehicle side door of said type.

In particular, the object is furthermore achieved by means of a push button device for actuating a functionality in a motor vehicle, wherein the push button device has:

- a mechanical and/or electric function controller which has a first control state and a second control state;
- a push button element with a manually actuable (or manually actuated) push button surface (that is to say it is the intention for said surface to be pressed for example by hand), wherein the push button element is pressable from a disengaged state into a pressed state by means of a pressing force, preferably along a movement direction of the push button element, wherein preferably, the push button element is moved further in an engaging direction with respect to a surface, immediately surrounding the push button device, of the motor vehicle when in the pressed state than when in the disengaged state, wherein the function controller has the first control state when the push button element is in the disengaged state, and the function controller has the second control state when the push button element is in the pressed state, the push button element is connected to the function controller via a first pivot arm which is mounted rotatably about an axis of rotation and via a second pivot arm which is mounted rotatably about a different axis of rotation which is spaced apart from the first axis of rotation, wherein the first pivot arm and the second pivot arm are designed to be pivoted in an identical direction of rotation as a consequence of a movement of the push button element.

By means of the pivot arms, the push button element is advantageously guided relative to the function controller, as the freedom of movement of the push button element is reduced. By means of said arrangement, which preferably corresponds to a four-bar linkage, stabilization of the orientation of the push button element is advantageously realized, such that the user can push against different points of the push button element but, here, the push button element does not tilt, or tilts only insignificantly, simply owing to the guidance by way of the pivot arms. Thus, substantially more translatory movement guidance is realized. By contrast to conventional guides of push button elements by way of linear rails, for example, blockage owing to jamming in the linear guide is prevented, and furthermore, the friction is lower. In relation to approximately translatory movements of the push button element, which are realized by way of a long lever arm and only one rotary joint, the use of two pivot arms offers the advantage that there is no need to use very long pivot arms (which are thus associated with high demands with regard to stiffness and structural space). According to the invention, the pivot arms can be produced from plastic, because they do not need to be very long, and therefore, said pivot arms exhibit adequate stiffness despite the fact that plastic per se is a soft material.

The push button device is preferably a device by means of which a user (for example driver or front passenger) can operate a particular function of the vehicle by pressing the push button element. In this case, after being pressed, it is not imperatively necessary for the push button element to return into the disengaged position of its own accord; rather, a push-push mechanism (similar functional principle to a ballpoint pen) is for example also possible. The push button device may preferably be installed in the interior compartment of the vehicle, or may be installed in the vehicle so as to be accessible from the outside. The push button device preferably has a holder which connects the pivot arms and the function controller. The push button device preferably has a preferably shell-shaped support in which the push button device is pre-installed.

A functionality in a motor vehicle may be understood to mean, for example, the following: the opening and/or closing of the vehicle (doors, tailgate, luggage compartment cover), the opening and/or closing of a flap (for example glove compartment, fuel tank cover, charging cover), folding-over/adjustment of seat surfaces, functions controllable by control element in the dashboard/cockpit/interior compartment lining (for example air-conditioning system, entertainment, turn signals/windshield washer system, electric window lifter).

A mechanical and/or electrical function controller is preferably to be understood to mean a device which records or detects a movement of the push button element and controls, for example activates or deactivates, the functionality in response thereto. The function control device may for example be purely mechanical, for example a Bowden cable or a control linkage and/or gear mechanism, may be purely electrical, for example a sensor arrangement with Hall sensor, or may be electromechanical, for example a microswitch. The function control device preferably controls an electrical and/or mechanical actuator. Said function control device is preferably positionally fixed with respect to the vehicle or with respect to the holder of the push button device.

The first control state and the second control state of the function controller are preferably to be understood to mean two different states which, for example, directly or indirectly influence the state of the functionality (for example on/off, closed/open).

An immediately surrounding surface of the vehicle may be in particular a door interior lining, seat lining, dashboard or (interior or exterior) sheet-metal regions of the vehicle which are visible or which lie within the reach of the user. The immediately surrounding surface of the vehicle is, for example, the exterior metal sheet of the vehicle door.

The push button element serves for the actuation of the functionality by the user. The push button surface preferably faces toward the user. Preferably, the push button element has an attached panel and the push button surface is the surface of the panel. Preferably, the user should press the push button surface in order to actuate the push button device. The required pressure force is preferably in the range from 1 N to 1000 N, particularly preferably from 10 N to 100 N, very particularly preferably in the range from 20 N to 40 N. The panel preferably covers openings of the push button element for the adjustment of the disengaged position and/or for the adjustment of the pressed-in position, preferably by means of a tool, preferably hand-operated tool (for example screwdriver), of the push button element relative to the holder or support. The push button surface preferably adjoins the surface of the vehicle (for example door surface) in approximately flush fashion. The push button element is preferably displaceable in substantially or approximately linear or translational fashion between the disengaged and pressed states. The push button element is preferably movable relative to the holder and/or relative to the function controller and/or relative to the vehicle door. The difference between the depressed and disengaged positions is preferably, in particular in the case of a door opener, less than 5 mm, particularly preferably less than 2 mm, and is very particularly preferably 1.5 mm.

The pivot arms are preferably highly rigid shaped parts, for example plastics injection moulded parts. It is preferable for the first pivot arm and the second pivot arm to be of equal length, that is to say for the spacing between the push button element-side attachment point and the function controller-side attachment point to be equal in the case of both pivot arms. It is furthermore preferable for the push button element-side attachment points to be spaced apart from one another by the same distance as the function controller-side attachment points. In this way, the pivot arms form a parallelogram with the push button element and with the function controller or the holder of the function controller.

An identical direction of rotation is to be understood to mean, for example, both pivot arms being pivoted clockwise. The movement of the pivot arms thus exhibits high parallelism.

In a further exemplary embodiment of the present invention, the push button device is a door opener and/or the function controller is an electric switch.

This gives rise to highly advantageous usage, firstly as a push button for opening the door, secondly for the electrical actuation of a functionality, for example the opening of the door.

The door opener is preferably an electric door opener for the actuation of an actuator of a vehicle door closure and/or of an actuator of a vehicle door opening and/or closing mechanism for installation into the vehicle door. The door opener is preferably a module which can be installed into a vehicle door. The door opener preferably does not have a handle, such that it is only possible for a pressing movement to be exerted on the door opener by the user. A vehicle door closure is preferably to be understood to mean the lock of the vehicle door, which has for example a latch mechanism and a locking mechanism. A vehicle door opening and/or closing mechanism is preferably to be understood to mean a mechanism by means of which the vehicle door is automatically pivoted open and/or closed and/or slid open and/or closed.

The vehicle door is for example a driver's door or front passenger's door or a tailgate.

The switch is preferably a switch for generating an electrical signal, wherein the first control state is a first switching state and the second control state is a second switching state. The switch is preferably a push button switch, preferably microswitch. A switch may also be understood to mean a sensor arrangement, for example with a Hall sensor or piezo element, which distinguishes between at least two different mechanical states and outputs a signal in a manner dependent thereon.

In a further exemplary embodiment of the present invention, at least one of the pivot arms is mounted between the push button element and the function controller via at least one rotary joint having a rotary joint axis.

In this way, more precise guidance of the push button element is achieved owing to the more stringent restriction of the freedom of movement of the push button element by the rotary joint. The rotary joint axis (axes) is (are) preferably the axis (axes) of rotation of the pivot element(s).

A rotary joint preferably has precisely one degree of freedom (rotation about an axis)—disregarding any joint play. A rotary joint is preferably formed between two (as far as possible rigid) components, wherein one component has a circular opening and the other component has a ring-shaped or cylindrical pin which engages, as far as possible without play, into the circular opening.

The one or more rotary joint axes are substantially perpendicular to the direction of the pressure force applied by the user for the actuation of the push button device. In this way, the one or more rotary joint axes can accommodate a translational movement component of the push button element, such that the one or more rotary axes have a guiding action. It is preferable for multiple rotary joint axes to be arranged parallel to one another and perpendicular to the direction of movement of the push button element.

In a further exemplary embodiment of the present invention, the push button device has a first rotary joint and a second rotary joint, each having a rotary joint axis, wherein the rotary joint axes of the first and second rotary joints are spaced apart from each other, and the push button element and the function controller are connected to each other via the first rotary joint, the first pivot arm and the second rotary joint, wherein the first and the second rotary joint are connected in series via the first pivot arm, and the push button device has a third rotary joint and a fourth rotary joint, each having a rotary joint axis, wherein the push button element and the function controller are furthermore connected to each other via the third rotary joint and the fourth rotary joint, and the third rotary joint and the fourth rotary joint are connected in series via the second pivot arm.

In this way, low-friction and rigid coupling is achieved. Owing to the spacing of the rotary joints to one another, the rotary joints can interact with one another and implement different movements.

By means of the connection of in each case two rotary joints in series, a guide for a translational movement (that is to say for example such that the pressure surface is displaced, as far as possible, in parallel) of the push button element is provided. A four-bar linkage is formed from rotary joints, such that a movement of a joint pair (first and second joint) is also transmitted to the movement of the other joint pair (third and fourth joint) and vice versa.

It is preferable for the first and third rotary joints to be arranged so as to be positionally fixed (in relation to the vehicle and/or holder and/or function controller), and the axes of rotation are spaced apart from one another. The second and fourth rotary joints are, with axes of rotation spaced apart from one another (preferably by the same distance as the first and third rotary joints), attached to the push button element at two different points (as close as possible to two opposite ends) or formed by the push button element (at least in each case one joint half).

In a further exemplary embodiment of the present invention, the push button device has a coupling arm which is spaced apart from the push button element and which couples the first pivot arm to the second pivot arm.

In this way, the coupling of the four-bar linkage is improved, and thus the stabilization of the orientation is yet further increased. The coupling arm transmits the movement of one pivot arm to the other pivot arm by compressive or tensile force. The parallelism of the movement of the pivot arms is thus forcibly realized in an even more effective manner than by means of the push button element alone.

In a further exemplary embodiment of the present invention, the push button device has a fifth rotary joint and a sixth rotary joint, each having an axis of rotation, wherein the first pivot arm is connected to the coupling arm via the fifth rotary joint and the second pivot arm is connected to the coupling arm via the sixth rotary joint.

In this way, low-friction and rigid coupling of the two pivot arms is realized by way of the coupling arm. The expressions "fifth rotary joint" and "sixth rotary joint" serve merely for improved distinction, but does not mean that it is imperatively necessary for the first, second, third and fourth rotary joints to be provided; rather, the fifth and sixth rotary joints may also be the only rotary joints. The axes of rotation of the fifth and sixth rotary joints are preferably arranged parallel to the existing rotary joint axes of other rotary joints (first to fourth rotary joints). The axis of rotation of the fifth rotary joint is preferably arranged at a distance from the connecting line between the first and second rotary joints, whereas the axis of rotation of the sixth rotary joint is arranged at a distance from the connecting line between the third and fourth rotary joints.

In a further exemplary embodiment of the present invention, the push button surface has a long side and a short side and the axis of the direction of rotation of the first and of the second pivot arm is perpendicular with respect to the long side.

This in particular serves to substantially reduce or prevent tilting along the long side. It is often desirable for a push button element to be provided which has a narrow or elongate pressure surface to be pressed by the user for the purpose of actuating the push button device, for example for reasons relating to structural space or design. Here, there is the problem that a push button element of such type can more easily tilt. However, the invention remedies this.

The long and short sides are preferably those sides of the push button element which delimit the push button surface and which the user, viewing the push button device, sees as the surface to be pressed. In the case of an oval push button surface shape or unusual other shapes, the long side is preferably the longest possible line through the geometric central point of the push button surface, and the short side is the shortest possible line through the geometric central point of the push button surface, wherein the line length is predefined by the outermost edges of the push button surface. The side ratio of long side to short side is preferably greater than or equal to 2:1, particularly preferably greater than or equal to 3:1, very particularly preferably greater than or equal to 4:1.

It is preferable, in the presence of joint pairs connected in series (for example first+second rotary joint; third+ fourth rotary joint; third rotary joint+ plain bearing), for two different joint pairs to be arranged, with the greatest possible spacing to one another (for example more than half of the side length), close to two opposite short sides.

In a further exemplary embodiment of the present invention, the push button device has:

- a first spring which acts upon the push button element with a first force in the direction of the disengaged state.
- a retaining device which defines the position of the disengaged state of the push button element.

In this way, by means of the retaining device, the position of the disengaged state can be determined and adapted to different installation situations. For example, it is possible for a flush termination of the push button device with the surrounding vehicle door surface to be defined. For this advantageous refinement, it is not imperatively necessary for the push button device to also have the pivot arms which pivot with the same orientation. For example, it is also possible for the push button element to be connected directly to the function controller by way of the first spring and/or some other, general joint. An advantageous synergistic effect between a provided kinematic arrangement according to the invention with at least two pivot arms and the retaining device is however that, in this way, the position of the disengaged state, and preferably also the orientation, can be defined very precisely and with very low friction.

The first spring is preferably a compression spring, for example leaf spring or leaf spring pack, which is arranged in force-transmitting fashion between push button element and function controller, which first spring may in this case be coupled for example to one or more of the provided pivot arms. By means of a leaf spring or a leaf spring pack, a structural space-saving realization of a compression spring is realized which is conducive to the small installation depth of the push button device (for example for installation into the vehicle door).

The first spring preferably acts on a movable part of a function controller which is in the form of a switch, for example on the push button head of a microswitch.

The retaining device preferably forms a stop (for example a static or adjustable projection), particularly preferably a deflecting stop, for example by way of a second spring, as discussed below.

In a further exemplary embodiment of the present invention, the first spring is a catch spring, for example a leaf spring with snap action effect.

A catch spring has the advantage of an audible click or perceptible snapping action when the spring overshoots a particular compressed state, which can be used as audible and/or tactile feedback for the user of the door handle. The catch spring is preferably of dome-shaped or conical form.

In a further exemplary embodiment of the present invention, the push button device has a second spring as part of the retaining device, which second spring acts upon the push button element with a second force in the direction of the pressed state.

In this way, the second spring forms a stop which deflects in the disengagement direction. Thus, during the disengagement movement of the push button element, there is not a sudden stoppage of movement but rather a smooth braking action until spring equilibrium is achieved between the first and second springs. The second spring is preferably a tension spring. It is preferably (in each case indirectly or directly) coupled in force-transmitting fashion at one side to the push button element, and at the other side to a part (which is positionally fixed with respect to the vehicle and/or holder) of the push button device; here, said second spring may for example be coupled to one or more of the provided pivot arms. The statement that the spring is part of the retaining device is also to be understood to encompass the situation in which the second spring is the only part of the retaining device, that is to say the retaining device is formed by the second spring.

The first spring preferably has a spring constant which is very high (for example greater by one, preferably two, particularly preferably three orders of magnitude) in relation to the spring constant of the second spring. In this way, the travel required for pressing in the push button element for the actuation of the function controller is approximately constant, such that even in the case of a push button element which has been adjusted by way of the adjuster (mentioned further below), the button feel is approximately the same. The change in the push button element then corresponds, for example, to the distance by which the screw of the adjuster is screwed in or out.

In a further exemplary embodiment of the present invention, the second spring is a wire bow spring which extends transversely, preferably substantially perpendicular, to the direction of movement of the push button element.

In this way, a particularly structural space-saving realization of a tension spring is realized which is conducive to the small installation depth of the push button device in the vehicle. The wire bow spring is preferably held by at least one positionally fixed hook preferably in the central region of the wire bow spring. It is preferable for the ends of the wire bow spring to act on the two pivot arms or on the push button element.

In a further exemplary embodiment of the present invention, the push button device has an adjuster by means of which the position of the disengaged state of the push button element can be adjusted.

In this way, even after installation, a fine adjustment of the rest position of the push button element (position of the disengaged state), for example an alignment with the surrounding surface of the vehicle, can be performed. The position of the disengaged state of the push button element, or rest position, is particularly preferably to be understood to mean the position of the push button element in the direction of the pressure force to be applied, that is to say, for example, the distance between the push button element and the function controller or the extent to which the push button element is recessed, or protrudes, with respect to the immediately surrounding surface of the motor vehicle.

In a further exemplary embodiment of the present invention, by means of the adjuster, the magnitude of the first force and/or the magnitude of the second force can be adjusted, and thus the position of the disengaged state of the push button element can be adjusted.

In this way, even after installation, a fine adjustment of a rest position, which is spring-loaded from both sides, can be performed in a simple manner. It is preferably possible for the preload of one or both springs to be varied by way of an adjustment element, for example a (grub) screw. Here, at least one of the coupling points of a spring is changed with regard to its relative position with respect to the push button element and/or with respect to the function controller.

In a further exemplary embodiment of the present invention, the adjuster has a screw which is acted on by one of the springs, wherein a preload of said spring can be adjusted by means of the screw.

This yields a simple adjustment facility with few components, which can be operated by way of a simple tool.

In a further exemplary embodiment of the present invention, the push button element has an opening for the operation of the adjuster preferably by means of a tool, in particular hand-operated tool (for example screwdriver). The opening preferably permits operation of the adjuster proceeding from the side of the push button surface (that is to say proceeding from the front side).

This yields simple accessibility for adjustment purposes.

In a further exemplary embodiment of the present invention, the push button device has at least one adjustable stop which defines a position of a maximally pressed state of the push button element.

In this way, adjustable overload protection is provided, such that the user cannot damage the function controller by pushing the push button element in with too great a force.

In a further exemplary embodiment of the present invention, the stop is a screw which is arranged at least partially below or within the push button element, wherein the push button element has an opening for the rotation of the screw, preferably by means of a tool, in particular hand-operated tool (for example screwdriver). The opening preferably permits operation of the adjuster proceeding from the side of the push button surface (that is to say proceeding from the front side).

In this way, a simple and space-saving means for adjustment is realized which requires no structural space to the side of the push button element and which can furthermore be concealed from the user, for example by way of a covering panel for the opening. The screw is preferably arranged, out of the view of an operator, below or within the push button element.

In a further exemplary embodiment of the present invention, the push button device has a sealing element which surrounds the push button element at least in regions and bears against said push button element and which has a bead which, in the installed state of the push button device, bears against the lower side of the immediately surrounding surface of the vehicle.

In this way, flexible sealing of the structural space in which the push button device is installed, for example of the vehicle door cavity, is realized, which can follow the movement of the push button element by virtue of the bead rolling on the lower side and which thus realizes a sealing action both in the pressed state and in the disengaged state. The bead thus adapts to the movement, in particular to a movement component of the structural element perpendicular to the surrounding surface, and permits a consistent sealing action. The push button element preferably has at least two positions, a first position and a second position, wherein the push button element is moved further in an engaging direction relative to the surface in the second position than in the first position, wherein, by means of a deformation of the bead from the first position in relation to the second position, a sealing action is realized in both positions.

The sealing element may preferably be used in other applications which relate not imperatively to a push button device but more generally to a seal of a gap between two components, which form the gap between them, of a vehicle below a surface, wherein the components move relative to one another (for example a tank cap and the surrounding vehicle surface). An advantageous synergistic effect between a provided kinematic arrangement according to the invention with at least two pivot arms which pivot with the same orientation and the sealing element is that the sealing action is more uniform, as the kinematic arrangement more effectively defines the orientation of the push button element. An advantageous synergistic effect between an adjuster and the sealing element is that, with the adjustability of the rest position of the push button element, the size of the contact surface of the bead against the lower side of the surface is also adjustable, whereby the sealing action is also adjustable. Furthermore, the influence which is exerted by the elastic sealing element on the spring equilibrium and which thus moves the push button element into an undesired rest position can be compensated.

What preferably suffices is a sealing action with respect to fouling (dust protection), particularly preferably spray water, wherein a spray water sealing action exists in particular at the top side of the sealing element in the installed state and preferably at the side surfaces. The sealing element preferably completely surrounds the push button element.

The bead is preferably formed by a convex bulge of the sealing element in the direction of the surface against which said bead is to bear, wherein the bead is particularly preferably of hollow form or concave on the other side, such that said bead is easily deformable and can thus particularly advantageously roll on the lower side. The contour of the convex side preferably runs substantially parallel to the contour of the concave side, that is to say, in the extreme case, the bead is formed by a bulge with constant material thickness. The bead preferably lies with the convex side against the lower side, or is set up in this way. It is preferable for that end of the bead which is averted from the push button element, that is to say an outer edge of the sealing element or the end which does not adjoin that region of the sealing element which bears against the push button element, to be at least regionally fixed relative to the lower side of the surface of the vehicle, for example by virtue of the sealing element, at its outer edge, being regionally, or across the lower side of the surrounding surface, pushed into one or more grooves. The grooves are for example part of a housing which bears the structural element, or said grooves are arranged directly on the lower side. The structural element is preferably held by a shell-shaped support which is fixed relative to the lower side of the surface of the vehicle, and that end of the bead which is averted from the structural element is at least regionally fixed to the support. In this way, the sealing element furthermore simultaneously serves as a seal between the support and the vehicle space surrounding the support.

The sealing element preferably defines an inner opening with an inner edge which bears against the push button element. The push button element preferably has an at least partially encircling shoulder on which the inner edge lies and is thus positioned in two directions. The bead of the sealing element preferably runs further outward.

In a further exemplary embodiment of the present invention, the bead has drainage depressions.

In this way, water which collects in the gap between the push button element and the immediately surrounding surface can run off or evaporate, whereas dirt continues to be effectively kept away. This furthermore promotes a self-cleaning effect, as dried dirt can be more easily blown out by the relative wind. It is preferable for the drainage depressions to be provided in particular on that side of the sealing element which is situated at the bottom in the installed state, such that water can simply flow off, but dirt is kept away.

In a further exemplary embodiment of the present invention, the push button element has an attachable panel, and the sealing element bears against the push button element and/or the panel in a gap between the panel and a surface of the push button element.

In this way, it is firstly possible for openings in the push button element (for example for adjustment) to be covered by the panel, wherein sealing (spray water and/or the dirt) between the push button element and panel is realized by way of the sealing element, and secondly, the panel holds the sealing element in position at its inner edge.

The panel is for example a panel, preferably chromium panel, whereby an appealing appearance can be attained without the push button element, which is cumbersome to produce owing to its attachment points to rotary joints and/or springs and/or other guide means, having to undergo expensive surface treatment. Said panel preferably has a surface which covers that side of the push button element which faces toward the user, at least to the extent that the user would see the push button device. The panel preferably has lateral projections which also laterally partially cover the push button element. The panel can preferably be mounted on the push button element by means of a snap-action fastener or by means of a mount-and-slide fastener (for example a linear bayonet fastener) with preferably L-shaped guide grooves.

Here, the gap may also be larger than the thickness of the sealing element at that location (for the desired sealing action, this is nevertheless sufficient), though the gap is advantageously of the same size as, or slightly smaller than, the thickness of the sealing element at that location, such that no residual gap remains.

In a further exemplary embodiment of the present invention, the sealing element has a region of high Shore hardness for abutment against the push button element, and/or the panel has a region of low Shore hardness for forming the bead.

In this way, it is firstly possible for the sealing element to be of more stable design in the region of the push button element and/or the panel, such that there, the assembly process is simpler and/or the mounting of the panel is easier, for example because the sealing element does not undesirably fold there. Secondly, the region in which the push button element rolls on the vehicle door inner surface (as the lower side of the immediately surrounding surface) can be designed to be soft, such that the rolling takes place in an advantageous fashion. The sealing element is preferably in the form of a two-component or multi-component injection moulding. Here, the region of high Shore hardness is preferably composed of a first component, and the region of low Shore hardness is preferably composed of a second component.

In a further exemplary embodiment of the present invention, the push button element has, on one side, a groove into which an inner edge of the sealing element is placed.

In this way, a fixing of the sealing element to the push button element is realized which is easy to assemble. In the case of a push button device which is a door opener, the lateral groove is preferably provided on that side of the push button element which, in the installed state of the door opener, is situated close to and parallel to the door side edge.

Figure 2A:
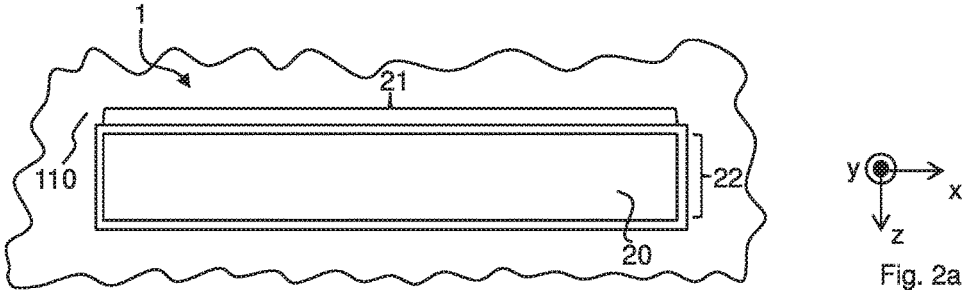
Figure 2B:
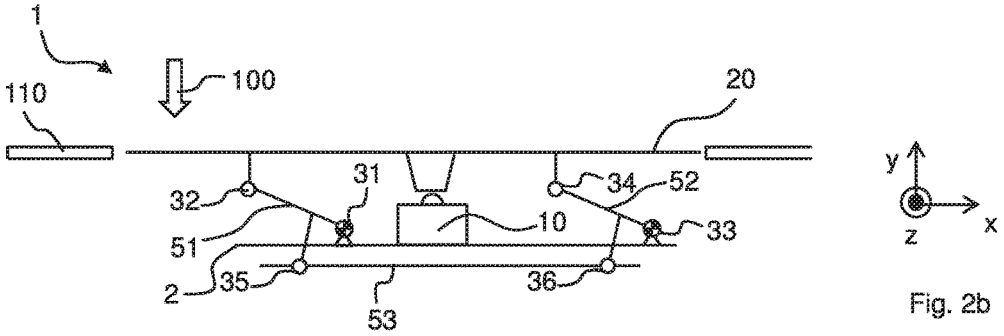
Figure 3:
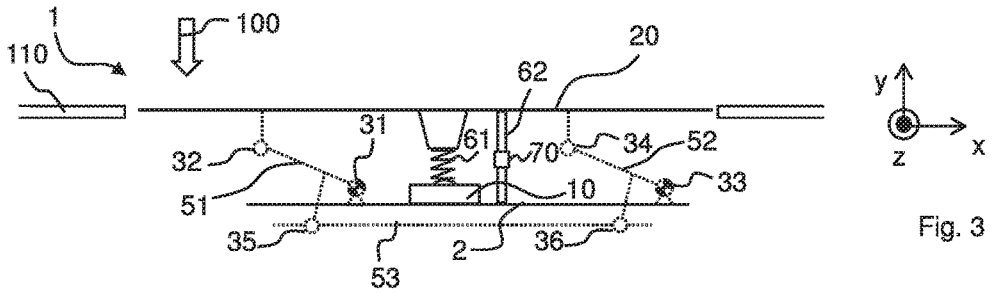
Figure 4A:
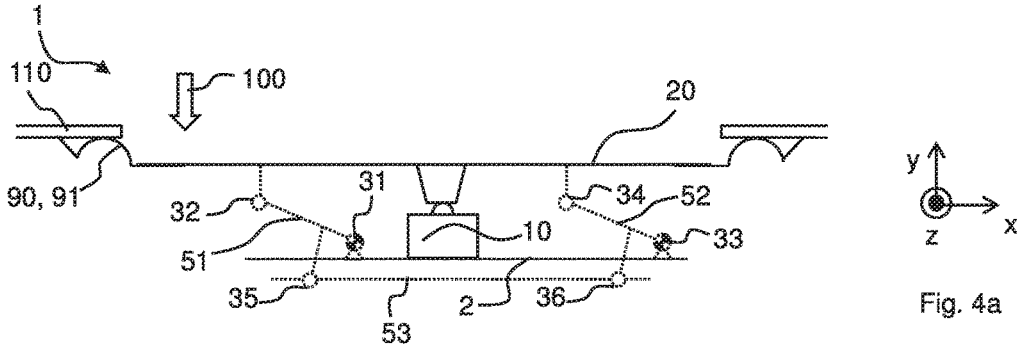
Figure 4B:
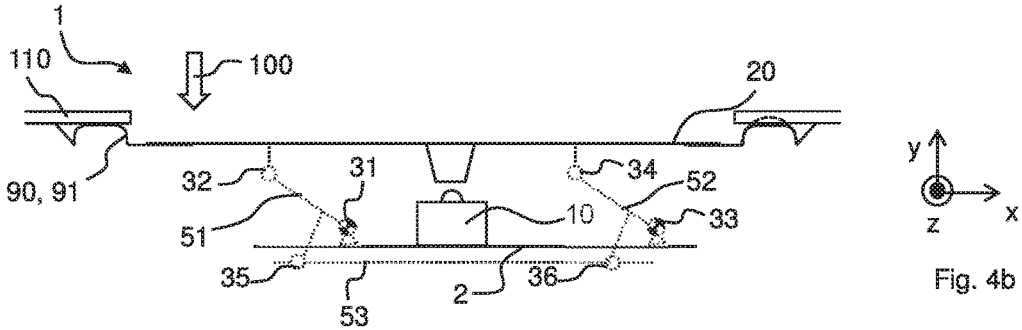

The invention will now be discussed in more detail by way of an example on the basis of drawings. In the drawings:

FIG. 1 shows a push button device according to the invention,

FIGS. 2*a-b* show a realization of the invention, furthermore with rotary joints, coupling arm and a push button element with long and short sides, FIG. 3 shows a realization of the invention with a retaining device, FIGS. 4*a-b* show a realization of the invention with a sealing device, FIGS. 5*a-d* show a realization of the invention based in particular on FIGS. 2*c*, 4, 4*a*, 4*b*, with a multiplicity of advantageous further features.

FIG. 1 shows a push button device according to the invention. The push button device 1 has a mechanical and/or electric function controller 10, shown in this case in the form of a switch, which has a first control state and a second control state. The push button device 1 has a push button element 20 with a manually actuable push button surface, wherein the push button element 20 can be pressed from a disengaged state into a pressed state by way of a pressing force 100. The push button element 20 is pushed further in an engaging direction relative to a surface 110, immediately surrounding the push button device 1, of the motor vehicle in the pressed state than in the disengaged state. The function controller 10 has the first control state when the push button element 20 is in the disengaged state, and has the second control state when the push button element 20 is in the pressed state. The push button element 20 is connected to the function controller 10 via a first pivot arm 51 which is mounted rotatably about an axis of rotation and via a second pivot arm 52 which is mounted rotatably about a different axis of rotation which is spaced apart from the first axis of rotation, wherein the first pivot arm 51 and the second pivot arm 52 are designed to be pivoted in an identical direction of rotation as a consequence of a movement of the push button element 20. Here, furthermore, a holder 2 is shown as part of the push button device 1, which holder connects the pivot arms 51, 52 and the function controller 10, wherein there may also be a connection between function controller 1 and push button element 20 via the pivot arms 51, 52 without holder 2.

This gives rise to a restriction of the freedom of movement of the push button element by the pivot arms 51, 52, which however permit the desired approximately translational movement at least in a particular rotational angle range. Here, tilting of the push button surface is greatly reduced owing to the pivot arm arrangement. Here, the pivot arms 51, 52 form a coupling, corresponding to a four-bar linkage, between the push button element 20 and the function controller 10, such that the pivot arms 51, 52 pivot approximately synchronously. If a user pushes on the push button element 20 with a force 100 far to the outside, as shown, the other end of the push button element 20 is also pulled downward by way of the pivot arm arrangement, as the freedom of movement of the push button element 20 on the other side is restricted by the pivot arm 52.

FIGS. 2*a-b* show, based on FIG. 1, a realization of the invention furthermore with rotary joints 31, 32, 33, 34, 35, 36, coupling arm 53 and a push button element 20 with a long side 21 and a short side 22. FIG. 2*a* is a plan view, and FIG. 2*b* is a side view of the push button device 1.

The two pivot arms 51, 52 are mounted between the push button element 20 and the function controller 10 by way of in each case two rotary joints 31, 32, 33, 34 with in each case one rotary joint axis. The push button device 1 has a first rotary joint 31 and a second rotary joint 32 with in each case one rotary joint axis, wherein the rotary joint axes of the first and second rotary joints 31, 32 are spaced apart from one another and the push button element 20 and the function controller 10 are connected to one another by way of the first rotary joint 31, the first pivot arm 51 and the second rotary joint 32. The first and the second rotary joint 31, 32 are connected in series by way of the first pivot arm 51. The push button device 1 has a third rotary joint 33 and a fourth rotary joint 34 with in each case one rotary joint axis, and the push button element 20 and the function controller 10 are furthermore connected to one another by way of the third rotary joint 33 and the fourth rotary joint 34. The third rotary joint 33 and the fourth rotary joint 34 are connected in series by way of the second pivot arm 52. By means of the rotary joints 31, 32, 33, 34, low-friction and otherwise rigid rotatable mounting of the pivot arms 51, 52 is realized.

The push button device 1 has a coupling arm 53 which is spaced apart from the push button element 20 and which couples the first pivot arm 51 to the second pivot arm 52. The push button device 1 has a fifth rotary joint 35 and a sixth rotary joint 36, each having an axis of rotation, wherein the first pivot arm 51 is connected to the coupling arm 53 via the fifth rotary joint 35 and the second pivot arm 52 is connected to the coupling arm 53 via the sixth rotary joint 36. In this way, the synchronization between the rotary joints 31, 33 is further improved, which is highly effective in particular in the angle range which is of interest for the translational movement of the push button element 20 (the two pivot arms 51, 52 approximately parallel and on one axis). If a user pushes on the push button element 20 with a force 100 far to the outside, as shown, the other end of the push button element 20 is also pulled downward by way of the rotary joint arrangement. By way of the rotary joint 32 and the pivot arm 51, the pivot arm 51 is pivoted about the rotary joint 31. Here, with the pivot arm 51, the rotary joint 35 is also pivoted, such that, in the selected arrangement, the coupling arm 53 exerts a pressure force on the rotary joint 36. Said pressure force pivots the pivot arm 52 about the rotary joint 33 and effects a pulling action on the push button element 20 via the rotary joint 34.

The push button surface has a long side 21 and a short side 22. The axis of the direction of rotation of the first and of the second pivot arm 51, 25 is perpendicular to the long side 21. In this way, tilting in particular along the long side 21 of the push button element 20 can be reduced.

FIG. 3 shows a realization of the invention with a retaining device 62. The push button device 1 has a first spring 61, which acts on the push button element 20 with a first force in the direction of the disengaged state, and a retaining device 62, which defines the position of the disengaged state of the push button element 20. The push button device 1 furthermore has an adjuster 70 by means of which the position of the disengaged state of the push button element 20 with respect to the Y direction can be adjusted. The kinematic arrangement with the at least two pivot arms 51, 52 is shown by way of dotted lines. A combination of the adjuster 70 with said kinematic arrangement is particularly advantageous owing to the precise definition of the rest position both in height (by way of the adjuster) and orientation (by way of the kinematic arrangement) of the push button element.

FIGS. 4*a-b* show a realization of the invention with a sealing device 90. The push button device 1 has a sealing element 90 which surrounds the push button element 20 and bears against said push button element and which has a bead 91 which, in the installed state of the push button device 1, bears against the lower side of the immediately surrounding surface 110 of the vehicle. FIG. 4*a* shows the pressed state of the push button element 20, and FIG. 4*b* shows the disengaged state. In FIG. 4*b*, it can be seen how the bead 90 bears more firmly against the lower side than in the engaged state (indicated on the right-hand side by way of a dashed line). In this way, a sealing action is realized for both states. Here, with a suitable small gap dimension, the sealing element 90 itself is practically not visible to the user, which gives a better visual impression.

Figures 5A, 5B:
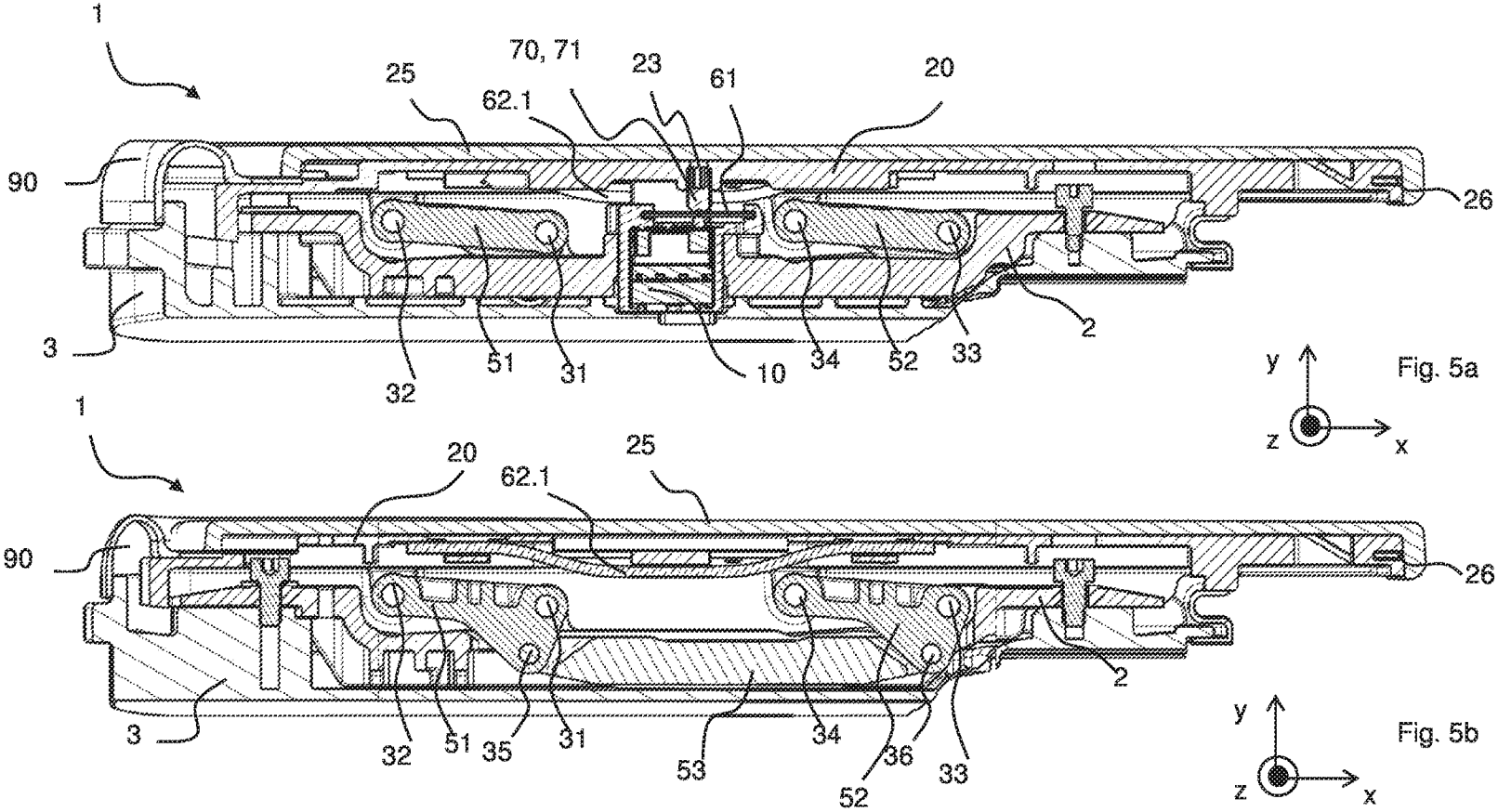
Figure 5C:
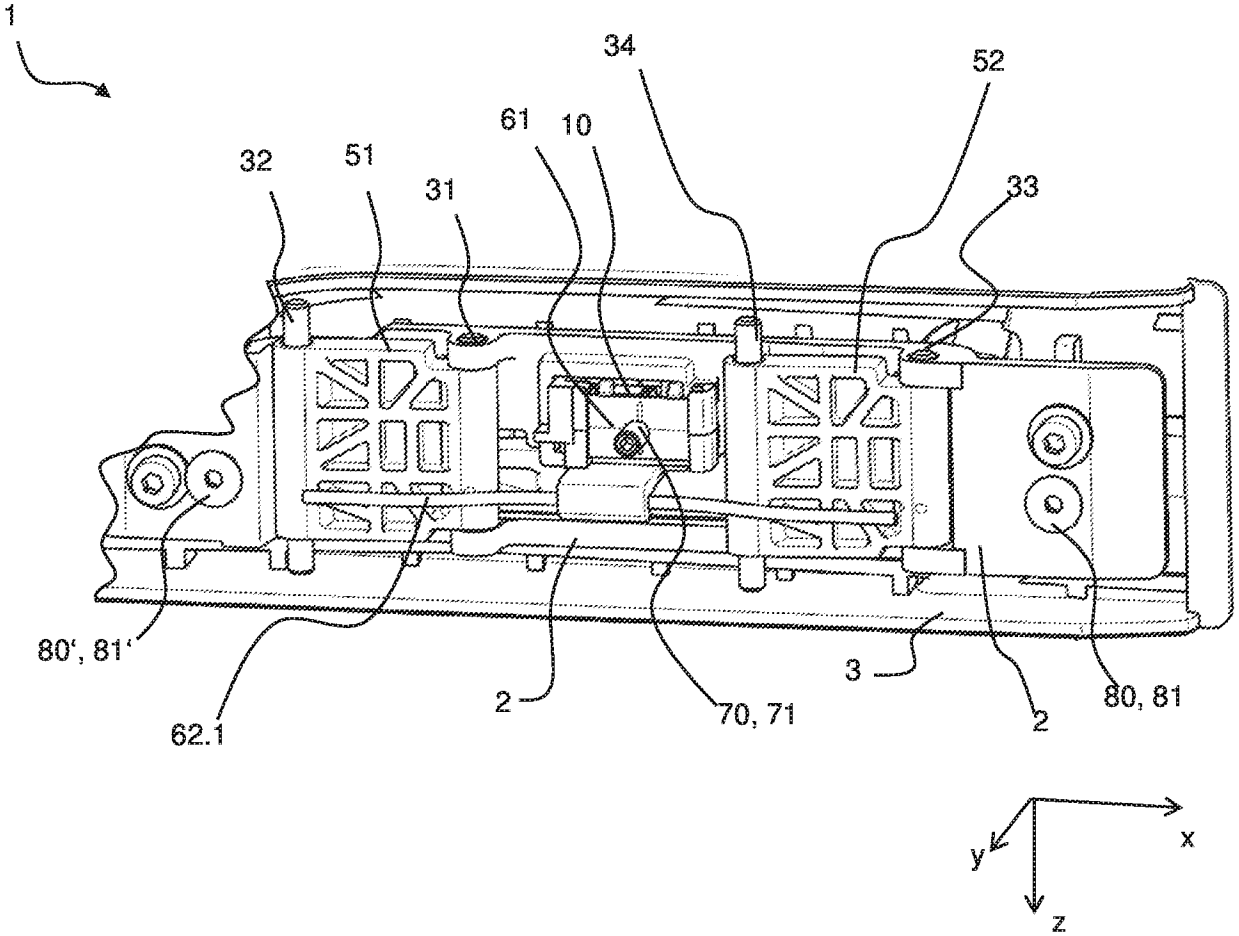
Figure 5D:
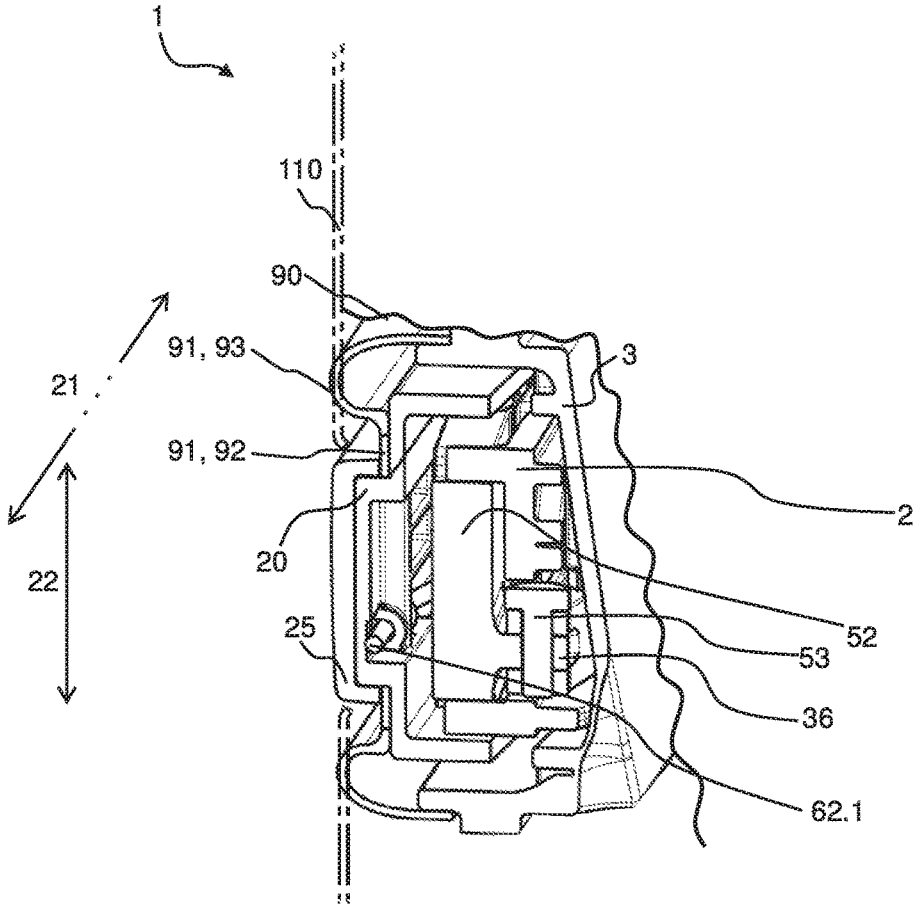
Figure 5D:
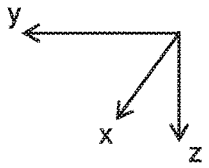

FIGS. 5*a-d* show a realization of the invention based in particular on FIGS. 2*c*, 4, 4*a*, 4*b*, with a multiplicity of advantageous further features. FIGS. 5*a* and *b* show two longitudinal sections at different Z positions. FIG. 5*c* shows a perspective view, wherein the push button element 20 has been removed for the purposes of the illustration, and FIG. 5*d* shows a perspective cross-sectional illustration. The push button device 1 is a door opener, and the function controller 10 is an electric switch. The first spring 61 is a catch spring which is designed as a leaf spring with a snap action effect. The push button device 1 has a second spring 62.1 as part of the retaining device 62, which second spring acts on the push button element 20 with a second force in the direction of the pressed state. By means of the adjuster 70, the magnitude of the first force and the magnitude of the second force (spring equilibrium exists) is adjustable, and thus a rest position of the push button element 20 is adjustable. The adjuster 70 has a screw 71 which is acted on by the first spring 61, wherein a preload of the first spring 61 is adjustable by means of the screw 71. By rotating the screw 71, the spring travel between the first and second springs 61, 62 is changed, such that a new force equilibrium, and thus a changed position of the push button element 20, are attained. The push button element 20 has an opening 23 for the operation of the adjuster 70. The second spring 62.1 is a wire bow spring which extends transversely, and substantially perpendicularly, with respect to the direction of movement of the push button element 20. The push button device 1 has at least two adjustable stops 80, 80' which define a position of a maximally pressed state of the push button element 20. The stops 80, 80' are screws 81, 81' which are arranged at least partially below or within the push button element 20. The push button element 20 has an attachable panel 25 and the sealing element 90 bears against the push button element 20 and the panel 25 in a gap between the panel 25 and a surface of the push button element 20. The sealing element 90 has a region of high Shore hardness 92 for abutment against the push button element 20, and/or the panel 25 has a region of low Shore hardness 93 for forming the bead 90. The bead 90 is shown in a relaxed position such as would be assumed if the surface 110 were not present. The push button element 20 has, on one side, a groove 26 into which an inner edge of the sealing element 90 is placed. The push button device 1 has a holder 2, which connects the first rotary joint 31 and the function controller 10, and a shell-shaped support 3, into which the push button device 1 is pre-installed. The push button element 20 is thus held by way of the holder 2 and the support 3, wherein the support 3 is fixed relative to the lower side of the surface 110 of the vehicle. That end of the bead 91 which is averted from the push button element 200 is at least regionally fixed to the support 3, whereby the sealing element 90 furthermore also seals off the interior of the support 3 with respect to the vehicle space below the surface 110.

With this invention, a universal control element is proposed which can be actuated by way of a push button movement, wherein, owing to the kinematic arrangement which is used, which has at least two pivot arms which rotate with the same orientation, it is possible to realize even large push button surfaces, as any tilting movements are intercepted or lessened by said kinematic arrangement. The push button element is preferably long and thin, and it is the intention for said push button element to be moved, in parallel fashion, inward below and further into a surface, for example in order to switch a microswitch. The movement of the push button element as a whole should be parallel, regardless of whether said push button element is pressed at one of the ends or in the middle. The relatively high opposing force (in relation to the dimensions of the push button element) necessitates a high stiffness of the pressure mechanism and of the push button element itself in order to permit a parallel and quasi-rigid appearance of the movement. Furthermore, the structural space is limited, such that the components cannot be designed to be arbitrarily voluminous. It is particularly preferable for a connection between the push button element and the holder to be provided by way of a coupled four-bar linkage. If the push button element is pressed inward from the front, the push button element is likewise pulled inward from the rear side by the kinematic arrangement. The push button element thus performs a movement which appears quasi-rigid. The use of said coupling mechanism permits the use of plastics as material, as the characteristic flexibility of plastics is compensated by the mechanism.

| List of reference numerals | |
|---|---|
| 1 | Push button device, for example electric door opener |
| 2 | Holder |
| 3 | Support |
| 10 | Function controller, for example switch |
| 20 | Push button element |
| 21 | Long side of the push button element |
| 22 | Short side of the push button element |
| 23 | Opening for screw 71 |
| 25 | Panel |
| 26 | Groove |
| 31 | First rotary joint |
| 32 | Second rotary joint |
| 33 | Third rotary joint |
| 34 | Fourth rotary joint |
| 35 | Fifth rotary joint |
| 36 | Sixth rotary joint |
| 51 | First pivot arm |
| 52 | Second pivot arm |
| 53 | Coupling arm |
| 61 | First spring |
| 62 | Retaining device |
| 62.1 | Second spring |
| 70 | Adjuster |
| 71 | Screw |
| 80 | Stop |
| 81 | Screw |
| 90 | Sealing element |
| 91 | Bead |
| 92 | Region of high Shore hardness |
| 93 | Region of low Shore hardness |
| 100 | Pressing force |
| 110 | Surface, immediately surrounding the push button device, of the vehicle |

The invention claimed is:

1. Push button device (1) for actuating a functionality in a motor vehicle, wherein the push button device (1) has:

a mechanical and/or electric function controller (10) which has a first control state and a second control state;

a push button element (20) with a manually actuable push button surface, wherein the push button element (20) is pressable from a disengaged state into a pressed state by means of a pressing force (100), wherein the push button element has a rest position when in the disengaged state, wherein the function controller (10) has the first control state when the push button element (20) is in the disengaged state, and the function controller (10) has the second control state when the push button element (20) is in the pressed state, wherein the push button element (20) is connected to the function controller (10) via a first pivot arm (51) which is mounted rotatably about a first axis of rotation and via a second pivot arm (52) which is mounted rotatably about a second axis of rotation which is spaced apart from the first axis of rotation, wherein the first pivot arm (51) and the second pivot arm (52) are designed to be pivoted in an identical direction of rotation as a consequence of a movement of the push button element (20), and wherein the push button device has:

a first spring (61) which acts upon the push button element (20) with a first force in the direction of the disengaged state, a retaining device (62) which defines the rest position of the disengaged state of the push button element (20), and an adjuster (70) by means of which the rest position of the disengaged state of the push button element (20) is adjustable.

2. Push button device (1) according to claim 1, wherein the push button device (1) is a door opener of a side door of a motor vehicle.

3. Push button device (1) according to claim 1, wherein the first pivot arm is mounted between the push button element (20) and the function controller (10) via a rotary joint having a rotary joint axis that defines the first axis of rotation.

4. Push button device (1) according to claim 1, wherein the push button device (1) has a first rotary joint (31) having a first rotary joint axis and a second rotary joint (32) having a second rotary joint axis, wherein the first rotary joint axis is spaced apart from the second rotary joint axis, and the push button element (20) and the function controller (10) are connected to each other via the first rotary joint (31), the first pivot arm (51) and the second rotary joint (32), wherein the first and the second rotary joint (31, 32) are connected in series via the first pivot arm (51), wherein the first rotary joint axis defines the first axis of rotation, wherein the push button device (1) has a third rotary joint (33) having a third rotary joint axis and a fourth rotary joint (34) having a fourth rotary joint axis, wherein the third rotary joint axis defines the second axis of rotation, and the push button element (20) and the function controller (10) are furthermore connected to each other via the third rotary joint (33) and the fourth rotary joint (34), and the third rotary joint (33) and the fourth rotary joint (34) are connected in series via the second pivot arm (52).

5. Push button device (1) according to claim 4, wherein the push button device (1) has a coupling arm (53) which is spaced apart from the push button element (20) and which couples the first pivot arm (51) to the second pivot arm (52).

6. Push button device (1) according to claim 5, wherein the push button device (1) has a fifth rotary joint (35) having a fifth rotary joint axis and a sixth rotary joint (36) having a sixth rotary joint axis, wherein the first pivot arm (51) is connected to the coupling arm (53) via the fifth rotary joint (35) and the second pivot arm (52) is connected to the coupling arm (53) via the sixth rotary joint (36).

7. Push button device (1) according to claim 1, wherein the push button surface has a long side (21) and a short side (22), and wherein the axis of the direction of rotation of the first and of the second pivot arm (51, 25) is perpendicular with respect to the long side (21).

8. Push button device (1) according to claim 1, wherein the first spring (61) is a catch spring.

9. Push button device (1) according to claim 1, wherein the push button device (1) has a second spring (62.1) as part of the retaining device (62), which spring acts upon the push button element (20) with a second force in the direction of the pressed state.

10. Push button device (1) according to claim 9, wherein by means of the adjuster the magnitude of the first force and/or the magnitude of the second force is adjustable and therefore the rest position of the disengaged state of the push button element (20) is adjustable.

11. Push button device (1) according to claim 10, wherein the push button device (1) has at least one adjustable stop (80) which defines a position of a maximally pressed state of the push button element (20).

12. Push button device (1) according to claim 11, wherein the push button device (1) has a sealing element (90) which surrounds the push button element (20) at least in regions and bears thereagainst and which has a bead (91) which, in the installed state of the push button device (1), bears against the lower side of the immediately surrounding surface (110) of the vehicle.

13. A push button device for actuating a functionality in a motor vehicle, wherein the push button device comprises:

a mechanical and/or electric function controller configured with a first control state and a second control state;

a push button element with a manually actuable push button surface, wherein the push button element is pressable from a disengaged state into a pressed state by a pressing force that moves the push button element toward the function controller, wherein the push button element has a rest position when in the disengaged state and the rest position defines a spacing between the push button element and the function controller, wherein the function controller is placed in the first control state when the push button element is in the disengaged state, and the function controller is placed in the second control state when the push button element is in the pressed state, wherein the push button element is connected to the function controller by a connection that includes a first pivot arm that is mounted rotatably about a first axis of rotation and by another connection that includes a second pivot arm that is mounted rotatably about a second axis of rotation that is spaced apart from the first axis of rotation, wherein the first pivot arm and the second pivot arm are arranged to be pivoted in an identical direction of rotation in response to movement of the push button element;

wherein the push button device includes:

a first spring that acts upon the push button element with a first force in a direction toward the disengaged state of the push button element, a retaining device configured to define the rest position of the disengaged state of the push button element, and an adjuster, located on the retaining device, and by which the rest position of the disengaged state of the push button element, and thereby the spacing between the push button element and the function controller when the push button element is in the disengaged state, is adjustable.

14. A push button device according to claim 13, wherein the push button device is a door opener of a side door of a motor vehicle.

15. A push button device according to claim 14, wherein the first pivot arm is mounted between the push button element and the function controller by a rotary joint having a rotary joint axis that defines the first axis of rotation.

16. A push button device according to claim 15, wherein the push button device has both a first rotary joint and a second rotary joint, wherein the first rotary joint has a first rotary joint axis that defines the first axis of rotation, wherein the second rotary joint has a second rotary joint axis that is spaced apart from the first rotary joint axis, wherein the push button element and the function controller are connected to each other by the first rotary joint, the first pivot arm and the second rotary joint, wherein the first and the second rotary joints are connected in series by the first pivot arm, wherein the push button device has a third rotary joint and a fourth rotary joint, wherein the third rotary joint has a third rotary joint axis that defines the second axis of rotation, wherein the fourth rotary joint has a fourth rotary joint axis that is spaced apart from the third rotary joint axis, wherein the push button element and the function controller are also connected to each other by the third rotary joint and the fourth rotary joint, and the third rotary joint and the fourth rotary joint are connected in series by the second pivot arm.

17. A push button device for actuating a functionality in a motor vehicle, wherein the push button device comprises:

a mechanical and/or electric function controller configured with a first control state and a second control state;

a push button element with a manually actuable push button surface, wherein the push button element is pressable from a disengaged state into a pressed state by a pressing force that moves the push button element toward the function controller, wherein the function controller is placed in the first control state when the push button element is in the disengaged state, and the function controller is placed in the second control state when the push button element is in the pressed state, wherein the push button element is connected to the function controller by a connection that includes a first pivot arm that is mounted rotatably about a first axis of rotation and by another connection that includes a second pivot arm that is mounted rotatably about a second axis of rotation that is spaced apart from the first axis of rotation, wherein the first pivot arm and the second pivot arm are arranged to be pivoted in an identical direction of rotation in response to movement of the push button element;

wherein the push button device includes:

a first spring that acts upon the push button element with a first force in a direction toward the disengaged state of the push button element, a retaining device configured to define the position of the disengaged state of the push button element, and an adjuster, located on the retaining device, and by which the position of the disengaged state of the push button element is adjustable;

wherein the push button device is a door opener of a side door of a motor vehicle;

wherein the first pivot arm is mounted between the push button element and the function controller by a rotary joint having a rotary joint axis that defines the first axis of rotation;

wherein the push button device has both a first rotary joint and a second rotary joint, wherein the first rotary joint has a first rotary joint axis that defines the first axis of rotation, wherein the second rotary joint has a second rotary joint axis that is spaced apart from the first rotary joint axis, wherein the push button element and the function controller are connected to each other by the first rotary joint, the first pivot arm and the second rotary joint, wherein the first and the second rotary joints are connected in series by the first pivot arm, wherein the push button device has a third rotary joint and a fourth rotary joint, wherein the third rotary joint has a third rotary joint axis that defines the second axis of rotation, wherein the fourth rotary joint has a fourth rotary joint axis that is spaced apart from the third rotary joint axis, wherein the push button element and the function controller are also connected to each other by the third rotary joint and the fourth rotary joint, and the third rotary joint and the fourth rotary joint are connected in series by the second pivot arm;

wherein the push button device has a coupling arm, which is spaced apart from the push button element, and which couples the first pivot arm to the second pivot arm, and the function controller is located between the push button element and the coupling arm.

* * * * *